US009347731B1

(12) United States Patent
Chang

(10) Patent No.: US 9,347,731 B1
(45) Date of Patent: May 24, 2016

(54) CROSSBOW DEVICE

(71) Applicant: Eldwin Chang, Taichung (TW)

(72) Inventor: Eldwin Chang, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/730,238

(22) Filed: Jun. 4, 2015

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS 4,947,822 A * 8/1990 Jones ..... F41B 5/12 124/25
5,522,373 A * 6/1996 Barnett ..... F41B 5/12 124/23.1
8,225,777 B2 * 7/2012 Chu ..... F41B 5/123 124/25
8,607,772 B2 * 12/2013 Barnett ..... F41B 5/12 124/25
2010/0224176 A1 * 9/2010 Kaylan ..... F41B 5/12 124/25

* cited by examiner

*Primary Examiner* — John Ricci

(57) ABSTRACT

A crossbow device at least comprises a stock with a body portion, a track, and a aiming position member. A lower bow portion is arranged at the front of the body portion which includes a connection portion and a first screw hole is arranged thereinside. A bow frame is fastened in the track and assembled with the aiming position member. A second screw hole is formed at the front of each rod. A bow string set is assembled with the bow frame. Tow positioning blocks are protruded in the limit groove and a third screw hole is arranged at each positioning block and corresponding to the second screw hole. A fourth screw hole is arranged at a hook portion and corresponding to the first screw hole. The screw members are screwed in the third screw hole, the second screw hole, and the fourth screw hole of the hook portion.

3 Claims, 6 Drawing Sheets

CROSSBOW DEVICE

BACKGROUND OF THE INVENTION

1. Field of the Invention

The present invention relates to a crossbow device, and especially relates to a device capable for shooting a projectile (such as arrow) in the steadiest and most accurate means and assembling and disassembling more convenient.

2. Description of Related Art

Bow is an object with killability and amusements and gradually progress from killing to the athletic items (the archery). The archery needs extreme concentration, applied skills of wrists and arms, and stability of feet. It really a good traditional exercise for physically and mentally training. There are two kinds of bow, one is archery shooter bow with half-moon shape and the other is crossbow with gun shape. They are different in use. The bow with half-moon shape must be pulled by two arms with large power and then the projectile (arrow) is shot by the elastic force. The crossbow is launched as gun and the projectile is shot only by fingers to pull the trigger to shoot the projectile. Although there are differences in shooting, the same thing is that users must stand stably, keep two arm balance and steady, and be skilled in fingers and wrists. Therefore, the projectile may be shot steady and smoothly and keep accuracy and stability. The crossbow needs more skills to accurately shoot.

Please refer to FIGS. 5 and 6, the conventional crossbow includes a bow body 10, a bow rod 20, and a bow string 30. An installed groove 101 is concavely arranged at a top end of the bow body 10 and one end thereof is open.

The installed groove 101 is slid in one end of the bow rod 20 and partially exposed to the bow body 10. A sliding groove 201 is laterally cut at the end of the bow rod 20 exposed to the bow body 10 and divided the bow rod 20 to an upper rod portion 202 and a lower rod portion 203. A bolt 40 is arranged at the end of the lower rod portion 203.

The bow string 30 is arranged at the end of the bow rod 20 exposed to the bow body 10 and against the side of the bow rod 20 with the bolt 40. A screw 50 is passed through the bow string 30 and then screwed with the bolt 40 so as to fasten the bow string 30 to the bow rod 20. The above mentioned structure is the conventional crossbow.

In order to reduce the weight of the crossbow, the bow rod 20 is mostly made by plastic materials because the metal bow rod 20 is too heavy to hold and aim stably. But, if the bow rod 20 is made by plastic materials, the bolt 40 is impossibly made by plastic materials because the bolt 40 needs to cooperate with the metal screw 50. There are many drawbacks describe as below.

Firstly, it is not easy to fasten the metal bolt 40 to the plastic bow rod 20. If the metal bolt 40 is fastened to the plastic bow rod 20, it is easy to make the bow rod 20 crack.

Secondly, if it made by inert molding, the cost will be increased and the insert part is easy to be damaged.

Thirdly, before shooting, the projectile is arranged on the slot 204 of the bow rod 20 and the deformation and crack of two side walls of the slot 204 are formed due to bearing the two side walls of the slot 204 in log-term use. Therefore, the projectile is not secured in the slot 204, and the resonance resulting from the deformation and crack of two side walls of the slot 204 after shooting is generated and louder. It is not acceptable for users. The sense of hearing will be influenced and make user emotionally unstable.

If the bow rod 20 is made by metal materials in order to prevent the bow rod 20 from cracking, the bow rod 20 is too heavy and the cost and price will be very high.

In view of the foregoing circumstances, the inventor has invested a lot of time to study the relevant knowledge, compare the pros and cons, research and develop related products. After quite many experiments and tests, the "crossbow device" of this invention is eventually launched to improve the foregoing shortcomings, to meet the public use.

SUMMARY OF THE INVENTION

An object of this invention is providing a crossbow device for shooting a projectile to improve the drawbacks of the prior art. It may aim stably, shoot smoothly and steady with low noise, prevent the projectile from over shifting, and reduce cost and price. The plastic body portion assembled to the bow string set by screws is easy to be cranked, or deformation and crack of the slot for setting up the projectile (such as arrow) may result from often bearing the two side walls of the slot so as to resonate while shooting. But if the body portion is made by metal materials, the weight of the crossbow is increased.

In order to improve above mentioned drawbacks, a crossbow device for shooting a projectile (such as arrow) is provided. The crossbow device may comprise:

a stock, having a body portion and a supporting portion, the supporting portion is arranged at a rear end of the body portion, a track with an open end is concavely arranged at an upper end of the body portion, an aiming position member is formed at one end of the track opposite to the open end, a firing hold portion is formed at a lower end of the body portion opposite to the upper end of the body portion formed the track, a fire member is arranged at the firing hold portion, a lower bow portion is formed at a front end of the body portion, a concave space is defined between a top surface of the lower bow portion and the front end of the body portion, a connection portion is formed at a front end of the lower bow portion, and a first screw hole is arranged at a front end of the connection portion;

a bow frame, installed at the body portion, one end of the bow frame is slidably installed in the track and connected with the aiming position member, the other end of the bow frame opposite to the end installed in the track is protruded from the track outwardly, a lateral cutting groove is defined between the end of the bow frame protruded from the track outwardly and the lower bow portion, the bow frame has two rods spaced apart from each other and a slot defined between the two rods and communicated with the lateral cutting groove, and a second screw hole is formed at a front end of each rod;

a bow string set, assembled with the end of the bow frame protruded therefrom and inserted into the lateral cutting groove, the bow string set includes a bow body with a half-moon shape and a shaft bush, a limit groove is further concavely arranged at a top surface of the bow body corresponding to the bow frame, a hook portion is further convexly arranged at the bow body corresponding to the connection portion, two positioning blocks are respectively protruded from an inner surface of each side of the limit groove corresponding to the second screw hole of each rod of the bow frame, and two third screw holes are respectively formed at each positioning block corresponding to the second screw hole of each rod of the bow frame, and a fourth screw hole is formed at the hook portion corresponding to the first screw hole of the connection portion of the lower bow portion, the shaft bush includes two steering wheels arranged at two ends of the bow body respectively, a let-off cable wound around a peripheral of each steering wheel, and a take-up cable wound around two sides of each steering wheel, the take-up cable is passed through the lateral cutting groove while the bow body and the bow frame are assembled each other, the let-off cable is arranged above the bow frame and releasably fastened at the aiming position member through being pulled by a user along a top surface of the bow frame; and a plurality of screw members, each is used for fasten the bow string set to the stock, one part thereof is screwed the third screw hole of each positioning block with the second screw hole of each rod of the bow frame, and the other part thereof is screwed the first screw hole of the connection portion of the lower bow portion with the fourth screw hole of the hook portion of the bow string set;

wherein the bow string set is firmly fastened to the body portion by the screw members so as to keep a center of the crossbow device securer and improve the accuracy of shooting while shooting, and the slot between the two rods is firmly screwed and fastened so as to securely support the bow string set and the bow frame, and the structure of the crossbow device is firmer and prevents from being deformed and cracked to improve noise while shooting.

In some embodiments, a thickness of the bow frame is smaller than or equal to half of a thickness of the lower bow portion.

In some embodiments, the bow frame is made by metal materials and the body portion is made by plastic materials.

Therefore, the thickness difference between the upper bow portion of the bow frame and the lower bow portion may make users steady hold for a long time and keep the best accuracy of shooting. Besides, the bow body is screwed to the upper bow portion of the bow frame so that the center of gravity of the bow body is located at the upper part and the bow body is not slanted to influence the accuracy of shooting. The deformation and crack of the slot of the bow frame can be prevented because the screws are screwed inside the bow frame. The resonance may also be reduced while shooting. The assemble and disassemble are easier and more convenient due to the arrangement of screws.

The various objectives and advantages of the present invention will be more readily understood from the following detailed description when read in conjunction with the appended drawing.

DETAILED DESCRIPTION OF THE INVENTION

Figure 1:
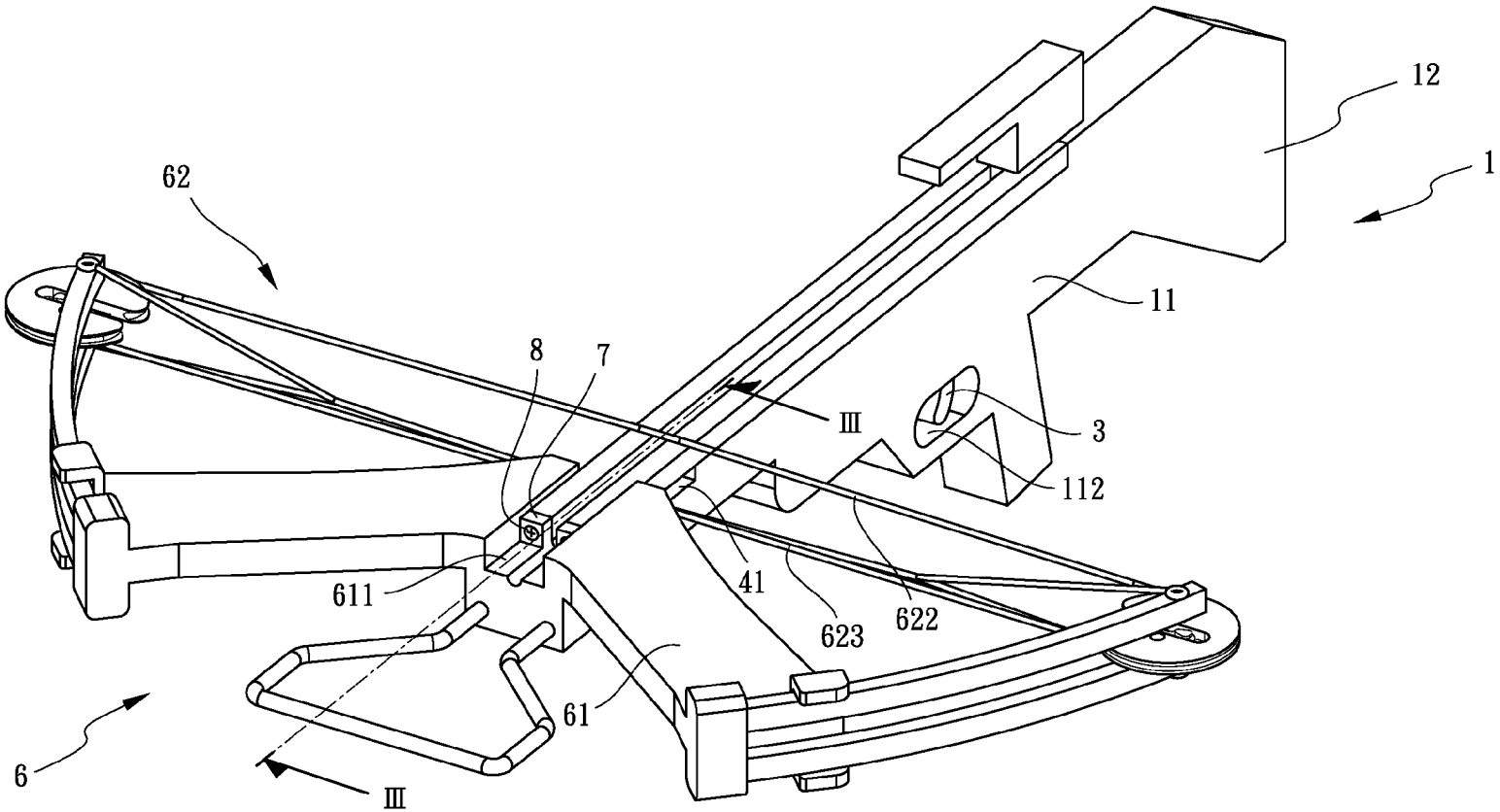
FIG. 1 is a perspective view of a crossbow device for shooting a projectile of the present invention.
Figure 2:
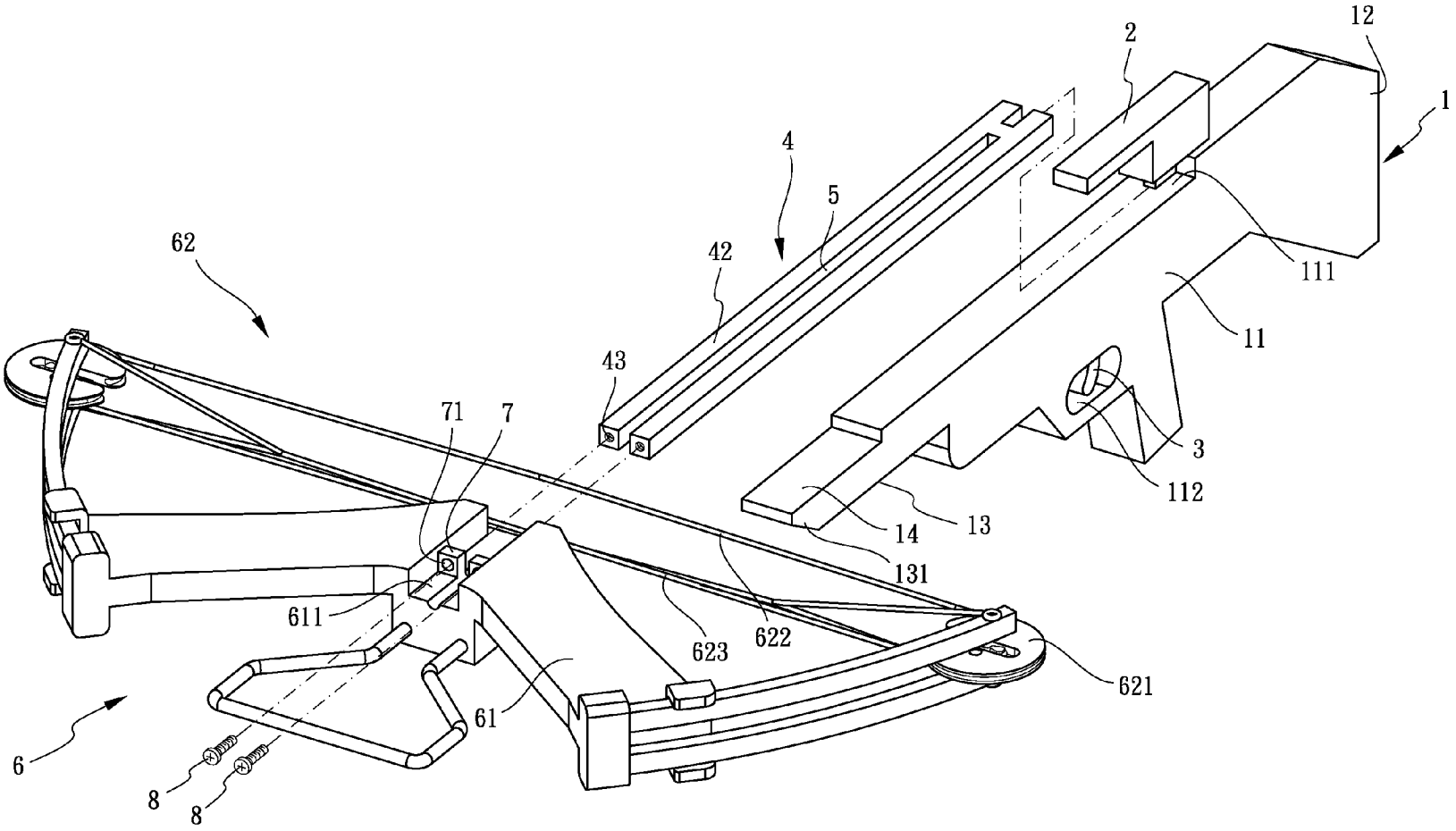
FIG. 2 is an exploded view of the crossbow device of the present invention.

To describe clearly that the present invention achieves the foregoing objective and function, the technical features and desired function are described with reference to a preferred embodiment and accompanying drawings.

Please reference to FIGS. 1 to 4, the present invention relates to a crossbow device for shooting a projectile (such as an arrow), which comprises as below.

A stock 1 may have a body portion 11 and a supporting portion 12. The supporting portion 12 may be arranged at a rear end of the body portion 11. A track 111 with an open end is concavely arranged at an upper end of the body portion 11. An aiming position member 2 may be formed at one end of the track 111 opposite to the open end. A firing hold portion 112 may be formed at a lower end of the body portion 11 opposite to the upper end of the body portion 11 formed the track 111. A fire member 3 may be arranged at the firing hold portion 112. A lower bow portion 13 may be formed at a front end of the body portion 11. A concave space 14 may be defined between a top surface of the lower bow portion 13 and the front end of the body portion 11. A connection portion 131 may be formed at a front end of the lower bow portion 13. And a first screw hole 132 may be arranged at a front end of the connection portion 131.

The firing member 3 may be used for controlling the aiming position member 2 to shoot the projectile. When in operation, the supporting portion 12 may be against the location with muscles (such as glenoid fossa or chest) of a user whose one hand is holding the firing hold portion 112 and the other hand is holding the lower edge of the front part of the body portion 11 with C shape to improve the actions of aiming and shooting, and then the firing member 3 is launched to release the bow string (let-off cable and take-up cable) to shoot the projectile.

A bow frame 4 may be installed at the body portion 11. One end of the bow frame 4 may be slidably installed in the track 111 and connected with the aiming position member 2, and the other end of the bow frame 4 opposite to the end installed in the track 111 may be protruded from the track 111 outwardly. A lateral cutting groove 41 may be defined between the end of the bow frame 4 protruded from the track 111 outwardly and the lower bow portion 13. The bow frame 4 may have two rods 42 spaced apart from each other and a slot 41 defined between the two rods 42 and communicated with the lateral cutting groove 41. And a second screw hole 43 may be formed at a front end of each rod 42. The slot 5 may be extended from the bow frame 4 toward the aiming position member 2 so that the projectile (such as arrow) may be arranged and positioned inside the slot 5 to prevent the shot projectile from slanting in shooting path and further keep the accuracy of shooting to minimize error.

A bow string set 6 may be assembled with the end of the bow frame 4 protruded therefrom and inserted into the lateral cutting groove 41. The bow string set 6 may include a bow body 61 with a half-moon shape and a shaft bush 62. A limit groove 611 may be further concavely arranged at a top surface of the bow body 61 corresponding to the bow frame 4. A hook portion 612 may be further convexly arranged at the bow body 61 corresponding to the connection portion 131. Two positioning blocks 7 may be respectively protruded from an inner surface of each side of the limit groove 611 corresponding to the second screw hole 43 of each rod 42 of the bow frame 4. Two third screw holes 71 may be respectively formed at each positioning block 7 corresponding to the second screw hole 43 of each rod 42 of the bow frame 4. A fourth screw hole 613 may be formed at the hook portion 612 corresponding to the first screw hole 132 of the connection portion 131 of the lower bow portion 13 (shown as in FIGS. 3 and 4). The shaft bush 62 may include two steering wheels 621 arranged at two ends of the bow body 61 respectively, a let-off cable 622 wound around a peripheral of each steering wheel 621, and a take-up cable 623 wound around two sides of each steering wheel 621. The take-up cable 623 may be passed through the lateral cutting groove 41 while the bow body 61 and the bow frame 4 are assembled each other. The let-off cable 622 may be arranged above the bow frame 4 and releasably fastened at the aiming position member 2 through being pulled by a user along a top surface of the bow frame 4. Therefore, the projectile may be shot straightly by the elastic force of the let-off cable 622 in the straightest shooting path and further improve the accuracy of shooting.

A plurality of screw members 8 may be included. Each screw member 8 may be used for fasten the bow string set 6 to the stock 1. One part of the screw members 8 may be screwed the third screw hole 71 of each positioning block 7 with the second screw hole 43 of each rod 42 of the bow frame 4, and the other part of the screw members 8 may be screwed the first screw hole 132 of the connection portion 131 of the lower bow portion 13 with the fourth screw hole 613 of the hook portion 612 of the bow string set 6 so that the bow string set 6 is firmly fastened with the stock 1 through the screw members 8 with three points fastening structure. Therefore, the bow string set 6 is firmly fastened to the body portion 11 by the screw members 8 so as to keep a center of the crossbow device securer and improve the accuracy of shooting while shooting. And the slot 5 between the two rods 42 is firmly screwed and fastened so as to securely support the bow string set 6 and the bow frame 4. And the structure of the crossbow device is firmer and prevents from being deformed and cracked to improve resonance noise while shooting.

The above mentioned structure is corresponding to the claim 1 for example, but not limited thereto.

When in operation, the bow body 61 is firmly fastened to the bow frame 4 by the screw members 8 so as to keep the center of the crossbow device securer, prevent the bow body 61 from slanting, and improve the accuracy of shooting while shooting. In addition, preferably, the bow frame 4 may be made by metal materials and the body portion 11 may be made by plastic materials. The stability of the structure of the crossbow device is achieved by screwing with the screw members. And the crossbow device is not heavy or not easy to be abraded or cracked to influence the accuracy of shooting.

Furthermore, before shooting, the projectile is arranged on the slot 5 of the bow frame 4 and the rods 42 form a stable structure since the second screw hole 43 of each rod 42 is firmly fastened to the third screw hole 71 of each block 7 by screwing the screw members 8 so that it is hard to be deformed or cracked by bearing after long-term use. The projectile is shooting with smooth whistle and it is stable and comfortable for a user.

It is also easy to assemble and disassemble due to fastening the bow body 61, the bow frame 4, and the body portion 11 by the screw members 8. For the conventional crossbow, it is complicated due to many elements which are easy to be confused, lost, and broken and inconvenient to be delivered. For this invention, the crossbow device can be disassembled to the bow string set 6 for one group and the bow frame 4 and the stock 1 for the other group so as to be delivered. And those two groups may be assembled by screwing the screw members 8. Besides shortening the assembly time and saving strength, compared to conventional crossbow, the crossbow device of this invention also prevents from elements lost and broken and is easy to be assembled for most users.

Figure 3:
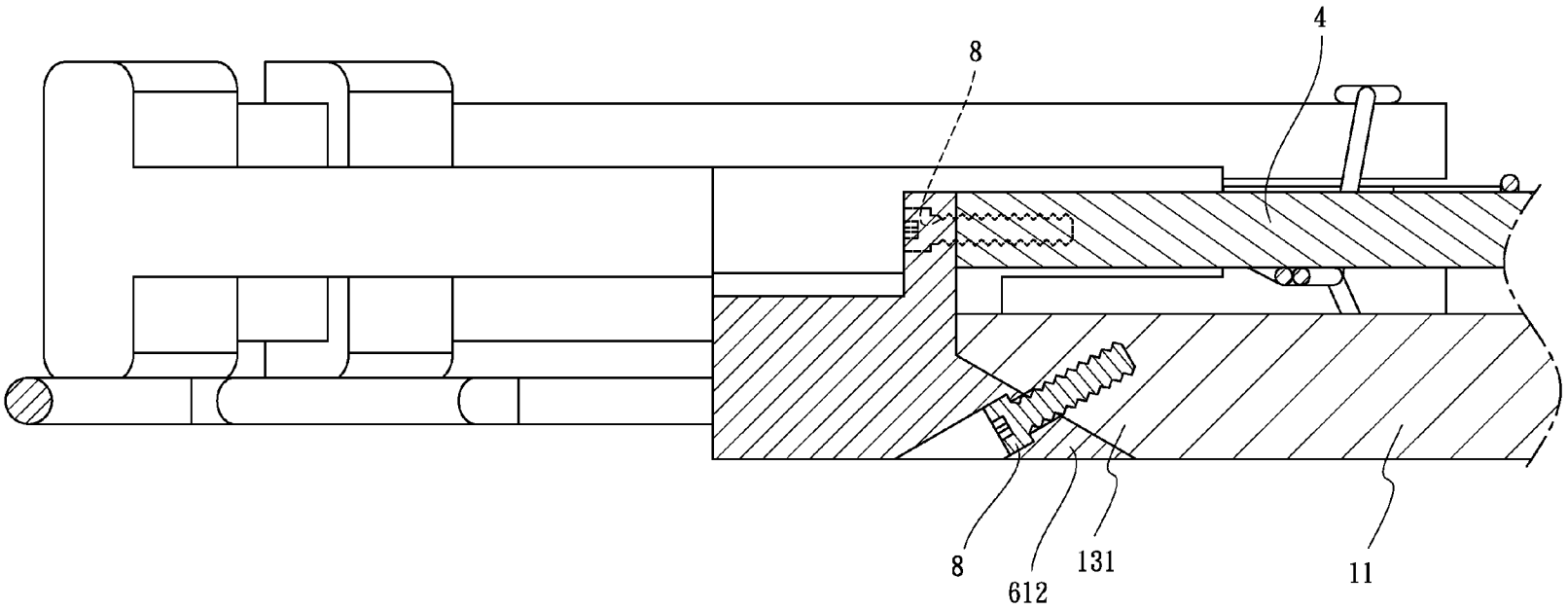
FIG. 3 is a cross-sectional view of FIG. 1 along line A-A.
Figure 4:
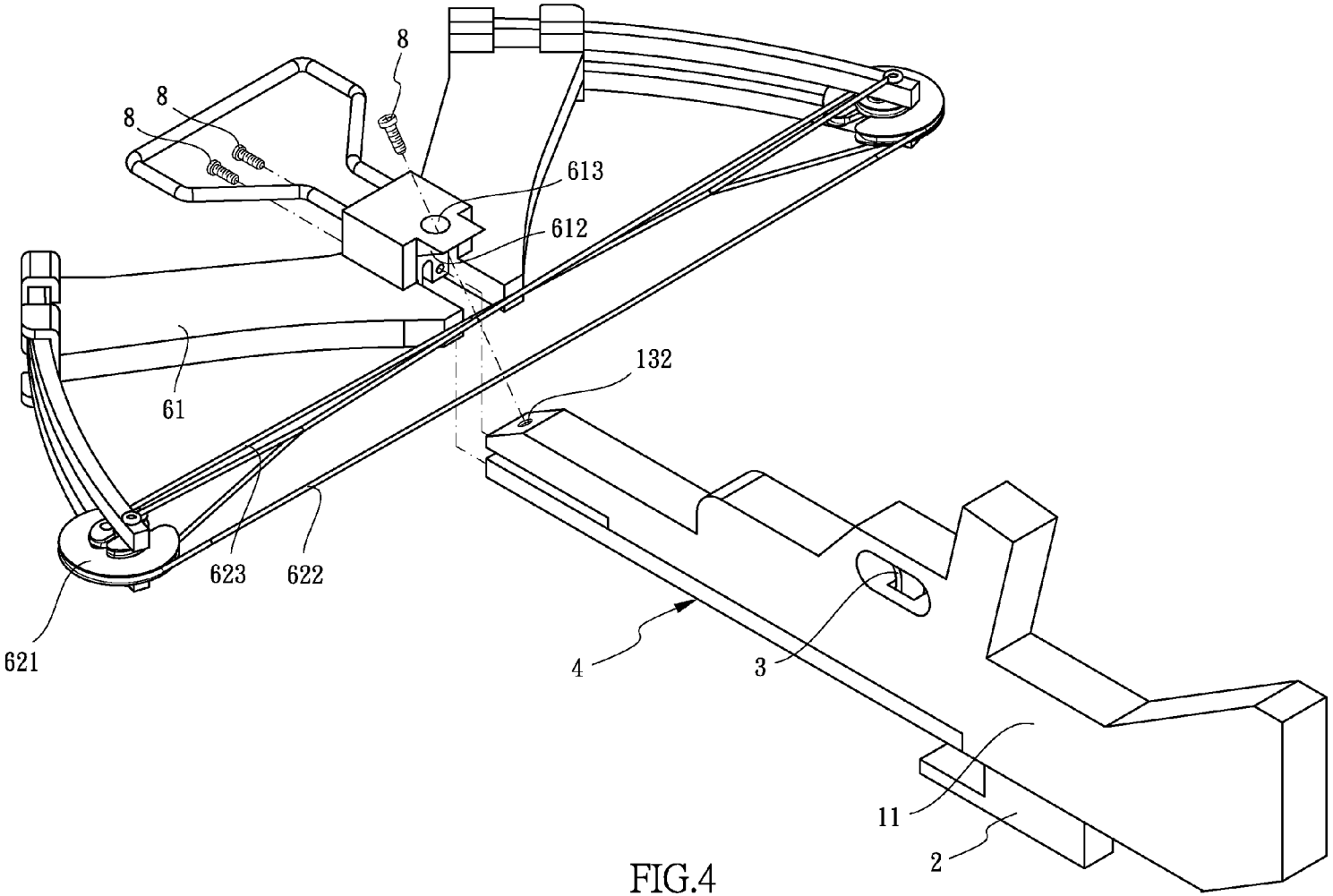
FIG. 4 is a perspective view of the crossbow device of the present invention with another different side.
Figure 5:
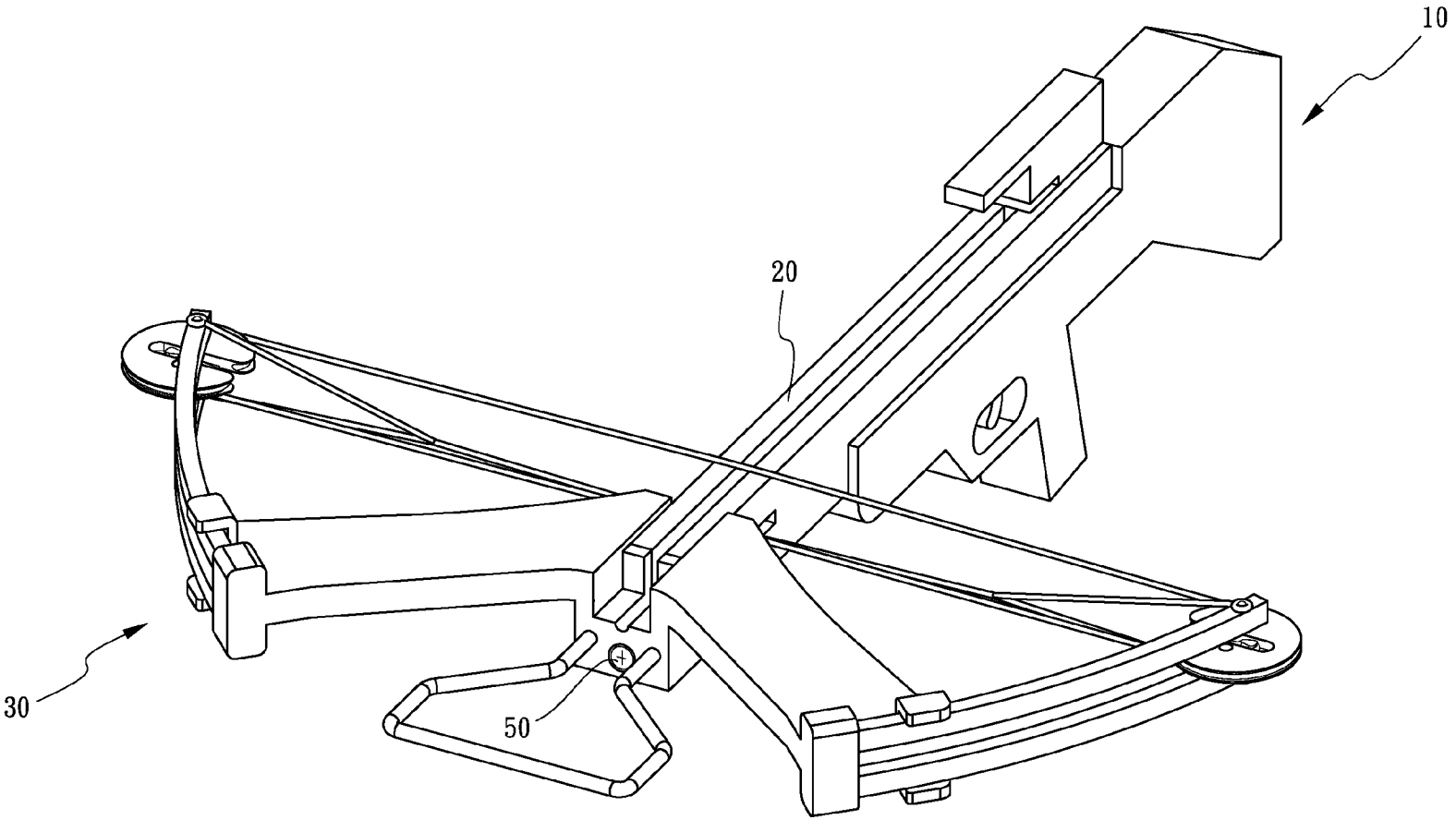
FIG.5 (Prior art)
FIG. 5 is a perspective view of the conventional crossbow device.
Figure 6:
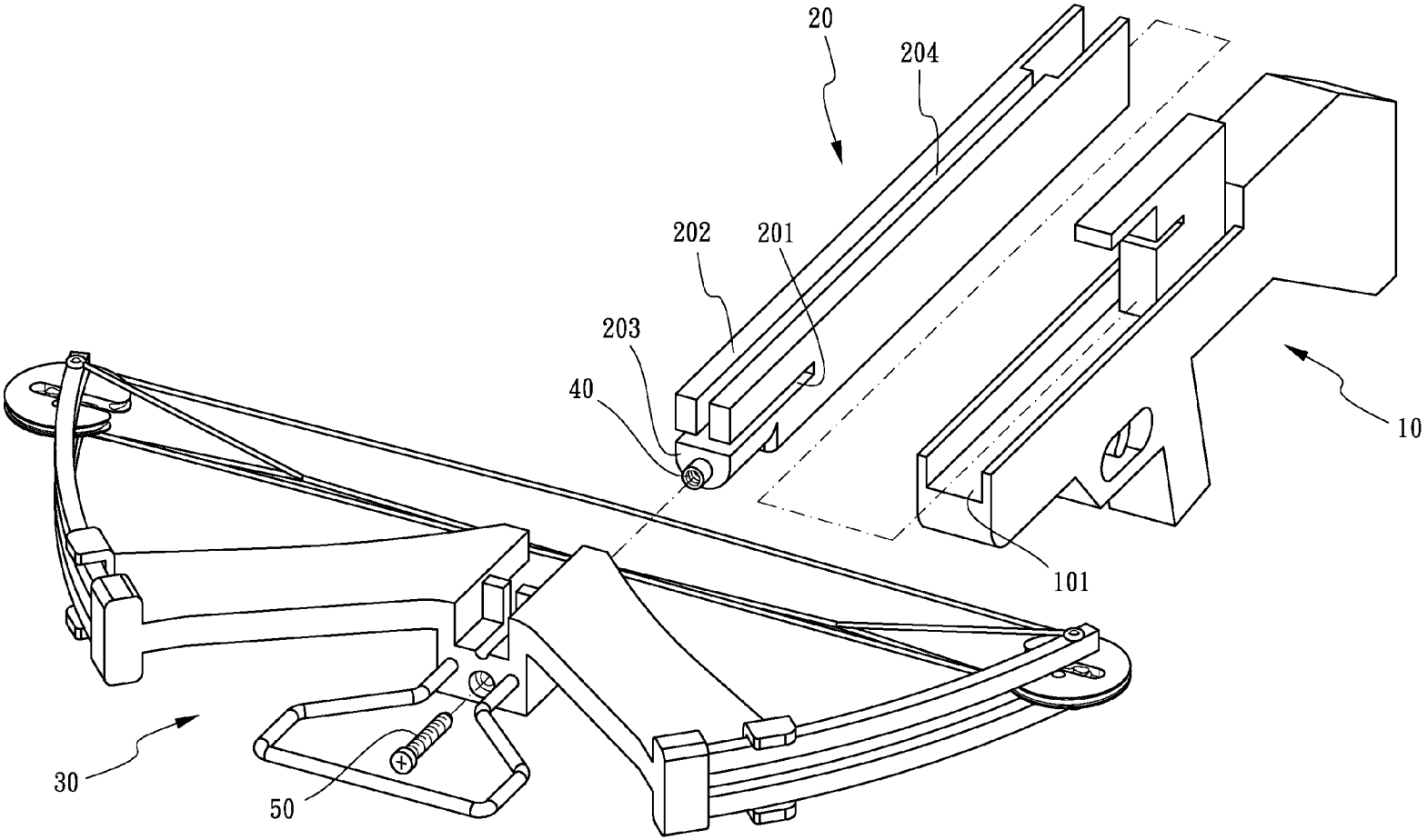
FIG.6 (Prior art)
FIG. 6 is an exploded view of the conventional crossbow device.

Additionally, in FIG. 3, the bow frame 4 and the lower bow portion 13 of the body portion 11 are divided by the lateral cutting groove 41. Preferably, the thickness of the bow frame 4 may be smaller than or equal to the thickness of the lower bow portion 13.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A crossbow device for shooting a projectile, comprising:

a stock, having a body portion and a supporting portion, the supporting portion is arranged at a rear end of the body portion, a track with an open end is concavely arranged at an upper end of the body portion, an aiming position member is formed at one end of the track opposite to the open end, a firing hold portion is formed at a lower end of the body portion opposite to the upper end of the body portion formed the track, a fire member is arranged at the firing hold portion, a lower bow portion is formed at a front end of the body portion, a concave space is defined between a top surface of the lower bow portion and the front end of the body portion, a connection portion is formed at a front end of the lower bow portion, and a first screw hole is arranged at a front end of the connection portion;

a bow frame, installed at the body portion, one end of the bow frame is slidably installed in the track and connected with the aiming position member, the other end of the bow frame opposite to the end installed in the track is protruded from the track outwardly, a lateral cutting groove is defined between the end of the bow frame protruded from the track outwardly and the lower bow portion, the bow frame has two rods spaced apart from each other and a slot defined between the two rods and communicated with the lateral cutting groove, and a second screw hole is formed at a front end of each rod;

a bow string set, assembled with the end of the bow frame protruded therefrom and inserted into the lateral cutting groove, the bow string set includes a bow body with a half-moon shape and a shaft bush, a limit groove is further concavely arranged at a top surface of the bow body corresponding to the bow frame, a hook portion is further convexly arranged at the bow body corresponding to the connection portion, two positioning blocks are respectively protruded from an inner surface of each side of the limit groove corresponding to the second screw hole of each rod of the bow frame, and two third screw holes are respectively formed at each positioning block corresponding to the second screw hole of each rod of the bow frame, and a fourth screw hole is formed at the hook portion corresponding to the first screw hole of the connection portion of the lower bow portion, the shaft bush includes two steering wheels arranged at two ends of the bow body respectively, a let-off cable wound around a peripheral of each steering wheel, and a take-up cable wound around two sides of each steering wheel, the take-up cable is passed through the lateral cutting groove while the bow body and the bow frame are assembled each other, the let-off cable is arranged above the bow frame and releasably fastened at the aiming position member through being pulled by a user along a top surface of the bow frame; and a plurality of screw members, each is used for fasten the bow string set to the stock, one part thereof is screwed the third screw hole of each positioning block with the second screw hole of each rod of the bow frame, and the other part thereof is screwed the first screw hole of the connection portion of the lower bow portion with the fourth screw hole of the hook portion of the bow string set;

wherein the bow string set is firmly fastened to the body portion by the screw members so as to keep a center of the crossbow device securer and improve the accuracy of shooting while shooting, and the slot between the two rods is firmly screwed and fastened so as to securely support the bow string set and the bow frame, and the structure of the crossbow device is firmer and prevents from being deformed and cracked to improve noise while shooting.

2. The crossbow device as claimed in claim 1, wherein a thickness of the bow frame is smaller than or equal to half of a thickness of the lower bow portion.

3. The crossbow device as claimed in claim 1, wherein the bow frame is made by metal materials and the body portion is made by plastic materials.

* * * * *